US005476226A

United States Patent [19]

Tomiita et al.

[11] Patent Number: 5,476,226

[45] Date of Patent: Dec. 19, 1995

[54] FUEL INJECTION VALVE WITH AN IMPROVED VALVE ELEMENT

[75] Inventors: Yukio Tomiita, Anjo; Hideo Kiuchi, Aichi, both of Japan

[73] Assignee: Nippondenso Co., Ltd., Kariya, Japan

[21] Appl. No.: 238,511

[22] Filed: May 5, 1994

[30] Foreign Application Priority Data

May 6, 1993 [JP] Japan ..... 5-105653

[51] Int. Cl.[6] ..... F02M 51/08

[52] U.S. Cl. ..... 239/585.5; 239/585.1; 239/533.11

[58] Field of Search ..... 239/533.11, 533.12, 239/584, 585.1, 585.4, 585.5

[56] References Cited

U.S. PATENT DOCUMENTS

| | | | |
|---|---|---|---|
| 3,368,761 | 2/1968 | Pecizzoni | 239/584 X |
| 4,519,547 | 5/1985 | Kubach et al. . | |
| 4,651,931 | 3/1987 | Hans et al. | 239/585.4 X |
| 4,779,838 | 10/1988 | Greiner et al. . | |
| 5,161,743 | 11/1992 | Takeda | 239/585.5 X |

FOREIGN PATENT DOCUMENTS

| | | | |
|---|---|---|---|
| 556803 | 8/1993 | European Pat. Off. . | |
| 3418762 | 11/1985 | Germany | 239/585.5 |
| 3418761 | 11/1985 | Germany | 239/585.5 |
| 54-8017 | 1/1979 | Japan . | |
| 2163460 | 6/1990 | Japan . | |
| 2123085 | 1/1984 | United Kingdom . | |
| 2198476 | 6/1988 | United Kingdom . | |

*Primary Examiner*—William Grant
*Attorney, Agent, or Firm*—Cushman, Darby & Cushman

[57] ABSTRACT

A valve element is slidably disposed in a guide bore in a valve casing, forming a fuel injection valve which is opened or closed by means of a valve seat of the valve casing and a contact portion of the valve element. When the valve element is in the valve open position, a first fuel adjusting passage is formed between the valve seat and the contact portion. A sliding contact portion is provided on the upstream side of the contact portion of the valve element, and a brim portion is provided on the further upstream side thereof. Flat portions are formed on the outer peripheral surface of the sliding contact portion, and adjusting surfaces are formed on the outer peripheral surface of the brim portion. Second fuel adjusting passages are formed between the fuel adjusting surfaces of the brim portion and the guide bore, and third fuel adjusting passages are formed between the flat portions of the sliding contact portion and the guide bore. The relationship between the pressure loss percentage P2 of the second fuel adjusting passages and the pressure loss percentage P3 of the third fuel adjusting passages is determined as P2≧P3≧6% of the total pressure loss.

10 Claims, 9 Drawing Sheets

FUEL INJECTION VALVE WITH AN IMPROVED VALVE ELEMENT

BACKGROUND OF THE INVENTION

1. Field of the Invention

The present invention relates to a fuel injection valve for injecting fuel, and is applied to a fuel injection valve for injecting fuel which actuates a valve element from the valve closed position to the valve open position by an electromagnetic actuator.

2. Description of Related Art

A conventional type of fuel injection valve includes a valve seat formed in a valve casing, a downstream fuel adjusting passage for adjusting fuel quantity in the clearance between the valve seat and a contact portion which comes into contact with the valve seat, and an upstream fuel adjusting passage for adjusting the injection quantity in the same way as the downstream fuel adjusting passage on the upstream side of the downstream fuel adjusting passage (as disclosed in the Japanese Unexamined Patent Publication Nos. 2-163460 and 59-20562, etc.).

In such a conventional type of fuel injection valve as shown in FIG. 10, a valve element 73 formed in needle-like shape is slidably disposed in a guide space 72 in a valve casing 71. A valve seat 74 is formed in a conical surface at one end of valve casing 71, a contact portion 75 is formed so as to come into contact with the valve seat 74 at one end of the valve element, a downstream fuel adjusting passage 76 is formed between the valve seat 74 and the contact part 75, and an injection port 77 is formed at the bottom surface of the valve casing 71.

In the valve element 73, a sliding contact portion 78 is formed so as to be slidably disposed in the guide space 72 on the upstream side of the contact portion 75 (upper side in FIG. 10), and flat portions 79 are formed on the sliding contact portion 78 to form fuel flow passages. A projection portion 80 is formed on the upstream side of the sliding contact portion 78, and upstream fuel adjusting passages 81 are formed on the projection portion 80 so as to form throttles. Fuel is supplied into the fuel injection valve, then the fuel injection quantity is adjusted in the upstream fuel adjusting passages 81, then the fuel flows to the downstream fuel adjusting passage 76 through the flat portions 79, then the fuel injection quantity is adjusted again in the downstream fuel adjusting passage 76, and the fuel is finally injected from the injection port 77.

However, in such a conventional type of fuel injection valve as the above, it has been confirmed with experiments by the inventors of the present invention that the shape of the atomized fuel injected from the injection port 77 is not stable.

Namely, when fuel is supplied into the fuel injection valve, fuel flow F1 occurs as indicated with arrows in FIG. 11. At this time, the fuel flowing through the upstream fuel adjusting passages 81 generates whirls (i.e, eddies) around the flat portions 79 which have no throttle, and causes the fuel backflow from the downstream side of the flat portions 79 to the upstream side of the flat portions 79. The fuel flow F1 became instable due to the whirls, the atomization angle of the fuel injected from the injection port 77 varies in a range between θ1 and θ2, for example, as shown in FIG. 12. As a result, there is a problem that the fuel injection is not maintained in a constant condition. Furthermore, it is likely that such problem is easily caused by a small error in the shape of the upstream fuel adjusting passages 81. In practical use mounted on vehicles, etc., such a conventional type of fuel injection valve may cause emission deterioration or insufficient drivability.

On the other hand, another conventional type of fuel injection valve, which does not have the sliding contact portion 78 shown in FIG. 10, has the upstream fuel adjusting passage immediately above the downstream fuel adjusting passage (e.g., as in the Japanese Unexamined Patent Publication No. 59-20562). Even in this case, however, it has been confirmed that an error in the shape of the upstream fuel adjusting passages causes an uneven shape of the atomized fuel or injection failure.

SUMMARY OF THE INVENTION

Accordingly, the present invention is made in view of the above problems, and therefore it is a primarily object to provide a fuel injection valve which can regularize the fuel flow in the valve casing and stabilize the fuel injection condition.

In order to achieve the above object, according to the present invention, a fuel injection valve for injecting fuel includes first fuel adjusting means formed between a valve seat and a valve element, or on the side of an injection port from the valve seat, for adjusting the quantity of fuel to be injected from the injection port by casing a predetermined pressure loss when the valve element and the valve seat are in a valve open position. The valve also has second fuel adjusting means formed on an upstream side of the first fuel adjusting means and cooperating with the first fuel adjusting means to adjust the quantity of fuel to be injected from said injection port by causing a predetermined pressure loss when the valve element and the valve seat are in the valve open position. Further included is third fuel adjusting means formed between the first fuel adjusting means and the second fuel adjusting means and cooperating with the first and second fuel adjusting means to adjust the quantity of fuel to be injected from the injection port by causing a predetermined pressure loss when said valve element and said valve seat are in said valve open position.

Further, it is preferable that the relationship between the pressure loss percentage P2 in the second fuel adjusting means and the pressure loss P3 in the third fuel adjusting means is predetermined as $P2 \geqq P3 \geqq 6\%$ of total pressure loss.

According to such a configuration, fuel flow in the valve casing is regularized and fuel injection condition is stabilized.

DETAILED DESCRIPTION OF THE PREFERRED EMBODIMENTS

(FIRST EMBODIMENT)

The first embodiment in which the present invention is modified is explained with respect to the drawings.

Figure 1:
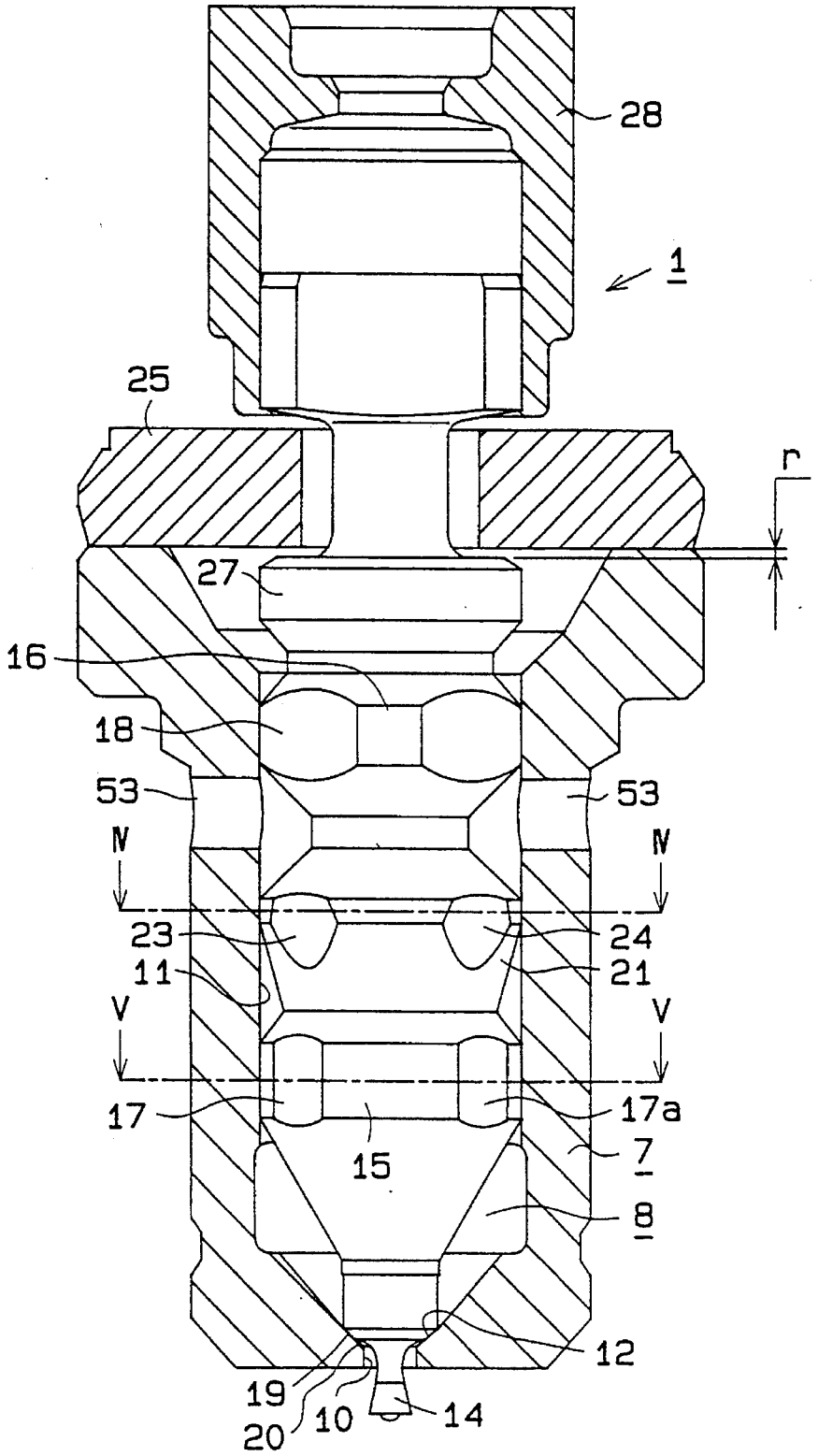
FIG. 1 is a cross-sectional view enlargingly showing the main portion in the first embodiment.
Figure 2:
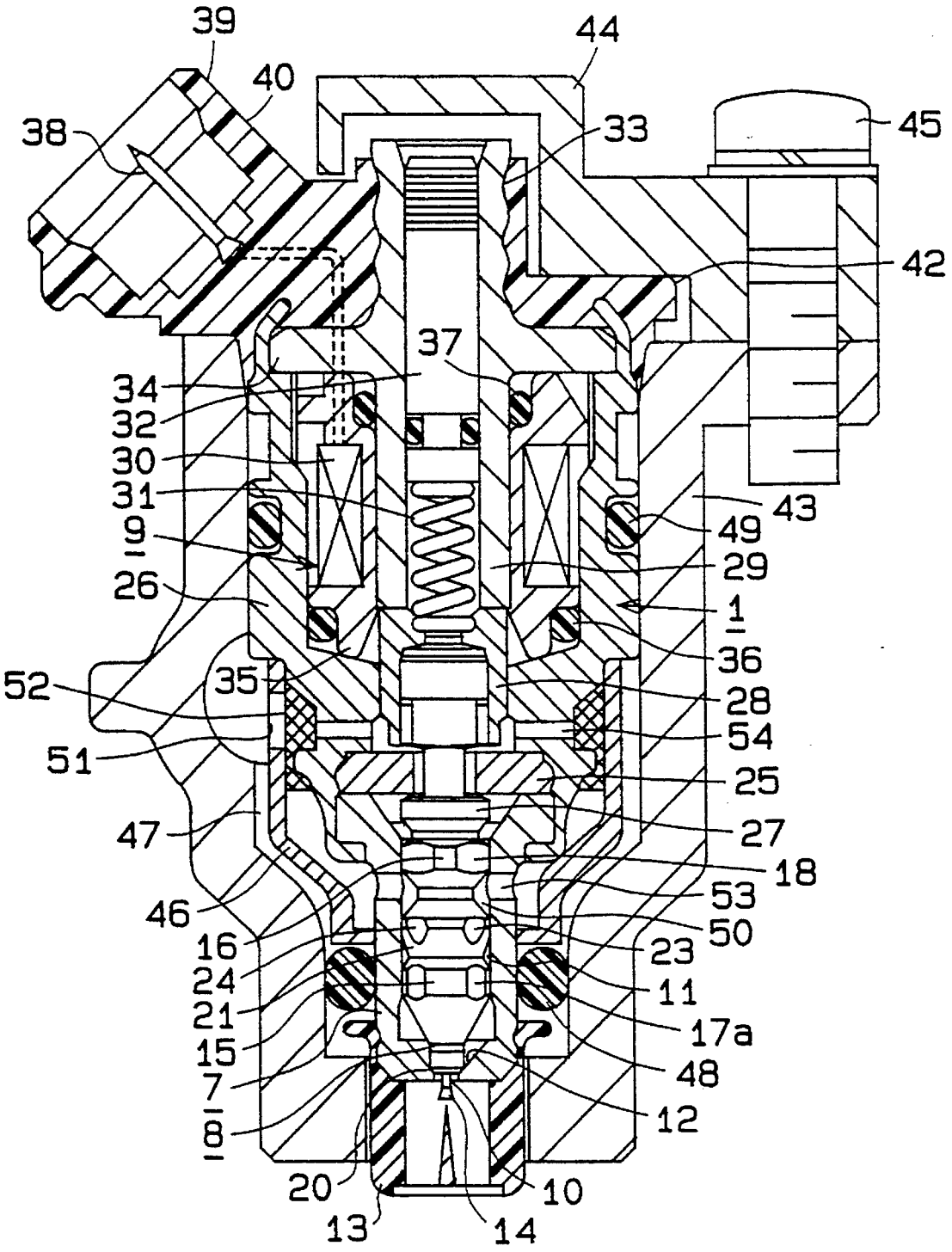
FIG. 2 is a cross-sectional view showing the overall structure of fuel injection valve in the first embodiment.
Figure 3:
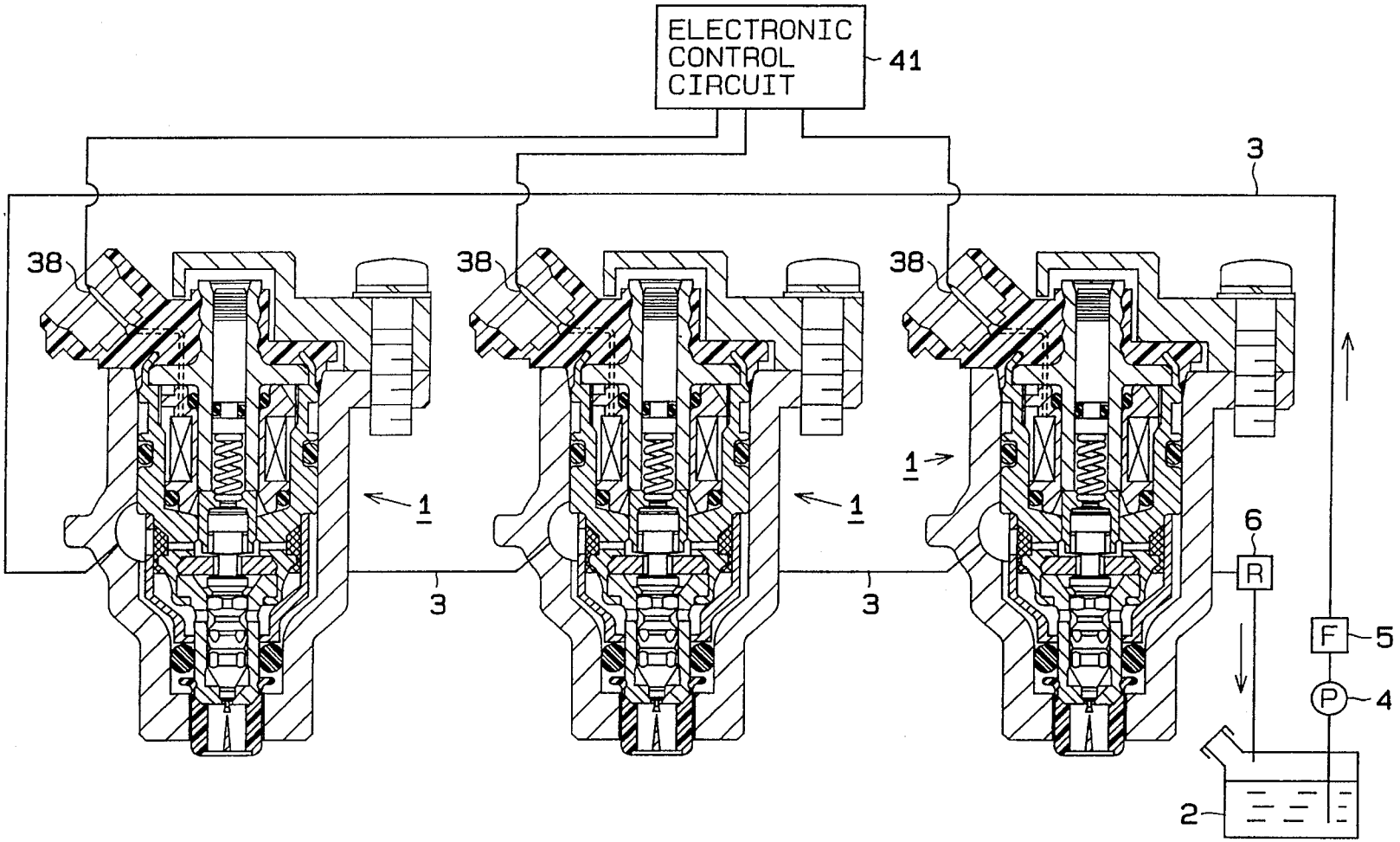
FIG. 3 is a configuration view schematically showing the fuel supply system in the first embodiment.
Figure 4:
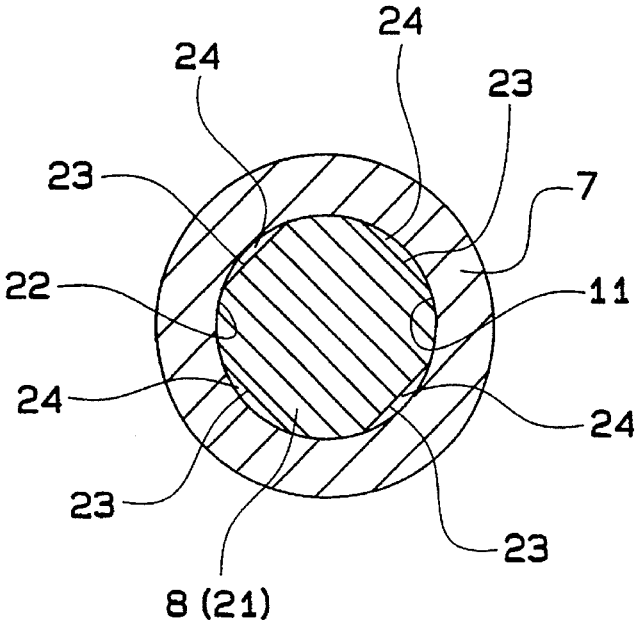
FIG. 4 is a cross-sectional view taken along line IV—IV in FIG. 1.
Figure 5:
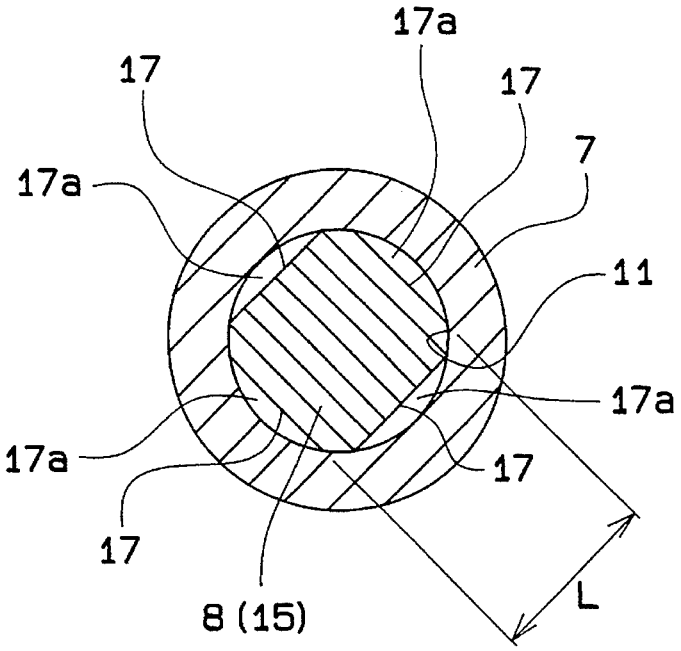
FIG. 5 is a cross-sectional view taken along line V—V in FIG. 1.

FIGS. 1 and 2 show the cross-sectional views of an electromagnetic fuel injection valve according to the first embodiment, FIG. 3 shows the outline of a fuel supply system for the fuel injection valve, FIG. 4 shows the cross-sectional view taken along line IV—IV in FIG. 1, and FIG. 5 shows the cross-sectional view taken along line V—V in FIG. 1.

In the fuel supply system shown in FIG. 3, a plurality of fuel injection valve 1, which supply fuel (i.e., gasoline) to the combustion chamber of a gasoline engine (not shown), are mounted in an intake manifold (intake pipe) which supplies air for the combustion chamber, in the vicinity of the combustion chamber. The number of the fuel injection valves 1 mounted on the intake manifold corresponds to the number of cylinders of the engine. The fuel supply system is equipped with a plurality of fuel pipes 3 to circulate fuel from a fuel tank 2 through the fuel injection valves 1 to the fuel tank 2 again. In these fuel pipes 3, an electric pump 4, a fuel filter 5, the fuel injection valves 1, the number of which corresponds to the number of cylinders of the engine, and a pressure regulating valve 6 are imposed in the recited order from the upstream end o the fuel circulation. The pressure regulating valve 6 maintains the difference in pressure of the fuel in the fuel pipes 3 from the electric pump 4 to the pressure regulating valve 6 at a constant value in proportion to the pressure in the intake manifold.

As shown in FIGS. 1 and 2, the fuel injection valve 1 is largely divided into a valve casing 7, a valve element 8 and an electromagnetic actuator 9.

The valve casing 7 is generally formed in a cylindrical shape, and has an injection port 10 at one end to inject the adjusted fuel into the intake pipe. The valve casing 7 also has a cylindrical guide bore 11 therein.

A valve seat 12, which has a conical surface extending to the injection port 10 at one end and to the guide bore 11 at the other end, is formed between the injection port 10 and guide bore 11 of the valve casing. The needle-like valve element 8 is housed in the guide bore 11. An injection port cover 13 is mounted on the side of the injection port 10 of the valve casing 7 to regulate fuel injected from the injection port 10 to the intake pipe.

The valve element 8 is integrally provided with a pin 14, one end of which extends into the inside of the injection port 10. The top end of the pin 14 is formed in conical shape to facilitate the atomization of fuel injected from the injection port 10. Sliding contact portions 15, 16 are formed adjacent to and around both ends of the valve element 8 respectively. The sliding contact portions 15, 16 are formed in annular projecting shape to be slidably disposed in the valve element 8 in the guide bore 11 of the valve casing 7. The sliding contact portions 15, 16 have a plurality (e.e., 4) flat portions 17, 18 on the outer peripheral surface respectively so as to form gaps between the flat portions 17, 18 the guide space 11 from the guide space 11 through which fuel flow smoothly.

A contact portion 19 is formed on the side of the pin 14 of the valve element 8 so as to come into contact with the valve seat 12 of the valve casing. When the valve element 8 is assembled into the fuel injection valve 1, the valve element 8 is movably disposed in the valve casing 7 between the valve closed position in which the contact portion 19 contacts the valve seat 12 and closes the injection port 10 and the valve open position in which the contact portion is apart from the valve seat 12 and closes the injection port 10 and the valve open position in which the contact portion is apart from the valve seat 12 so as to form a predetermined gap and opens the injection port 10.

When the valve element 8 is in the valve open position, the firs fuel adjusting passage 20 is formed as a downstream side fuel adjusting passage in an annular gap formed between the valve seat 12 and the contact part 19 to adjust the fuel injection quantity.

A brim portion 21 formed in annular projecting shape between the sliding contact portions 15 and 16 positioned on the upstream side from the contact portion 19 of the valve element 8. The brim portion 21 includes a body portion 22 which slides the inner peripheral surface of the guide space 11, and the body portion 22 includes a plurality of (e.g., 4) fuel adjusting surfaces 23 formed on the flat portions on the outer periphery thereof. The second fuel adjusting passage 24 are formed in gaps between the fuel adjusting surfaces 23 and the guide bore 11 in the valve casing 7, and pressure loss (throttle) is caused by the above gaps in the fuel introduced into the second fuel adjusting passages 24, whereby the fuel injection quantity is adjusted (refer to FIG.4).

Furthermore, the third fuel adjusting passages 17*a* are formed in gaps between the flat portions 17 formed on the outer peripheral surface of the sliding contact portion 15 positioned on the downstream side of the second fuel adjusting passages 24 and the guide bore 11 of the valve casing 7 and pressure loss is caused by the gaps in the fuel introduced into the third fuel adjusting passages 17*a*. In this embodiment, the length L of the side of the cross-section of the third fuel adjusting passages 17*a*, is 4.73 mm (refer to FIG. 5). It is clearly understood that the cross-sectional area of each gap of the third fuel adjusting passages 17*a* is smaller than that of the conventional fuel injection valve having no throttle (the length L is 4.2 mm). Thus, in this embodiment, the throttles of the upstream fuel adjusting passages side are formed by the second fuel adjusting passages 24 and the third fuel adjusting passages 17*a*.

Here, the pressure loss percentages of the first, second and third fuel adjusting passages 20, 24 and 17*a* in this embodiment are explained. The ratio of the pressure loss percentages (P2+P3) of the second and third fuel adjusting passages 24 and 17*a* together forming throttles of the fuel adjusting passages at the upstream side, to the pressure loss percentage P1 of the first fuel adjusting flow passage 10 forming the fuel adjusting passage at the downstream side is set to a predetermined design value (e.g., approx. 20%: approx. 80%), preferably to P2+P3≦50%. The pressure loss amount on the upstream side is divided by the second and third fuel adjusting passages 24 and 17*a*, and the pressure loss percentage P2 of the second fuel adjusting passages 24 and pressure loss percentage P3 of the third fuel adjusting passages 17*a* are set to P2≧P3≧6% (of the total pressure loss). That is, the pressure loss percentage of the throttle positioned on the downstream side is 6% or more, and the pressure loss percentage of the throttle positioned on the upstream side is equivalent to or more than that positioned on the downstream side. The remaining pressure loss is shared with the first fuel adjusting passage 20. Although the pressure loss may be caused by the gap between the injection port 10 and the pin 14, such pressure loss is treated herein as negligible (5% or less, if any) by widening the gap to a comparatively large dimension.

On the other hand, the other side of the valve element 8 in opposition to the end with the pin 14 is inserted through the hole bored in a ring-shaped stopper 25.

The stopper 25 is fixedly held between a cylindrical casing 26 covering the outer peripheral surface of the electromagnetic actuator 9 and an end of the valve casing 7. A flange 27 is formed into an annular projecting shape on the valve element 8 in adjacent to the stopper 25. When the valve element 8 is pulled up by the electromagnetic actuator 9, the flange 27 contacts the stopper 25 so as to define the valve opened position of the valve element 8. At this time, the distance from the valve closed position to the valve open position for which the valve element 8 shifts is referred to as "needle lift amount Γ" (refer to FIG. 1). The end portion of the valve element 8 on the opposite side of the pin 14 extends through the stopper 25 into the casing 26.

The electromagnetic actuator 9 is housed in the casing 26 to actuate the valve element 8 between the valve closed position and the valve open position. The electromagnetic actuator 9 largely comprises an armature 28, a stator 29 and a solenoid 30.

The armature 28, which is made of a magnetic material, is connected to the end portion of the valve element 8 on the opposite of the pin 14 so as to be movably disposed together with the valve element 8 in the axial direction of the valve element 8. Pressure is constantly applied on the armature 28 by a return spring 31 towards the side of the valve element 8 (towards the lower side in FIG. 1). The stator 29, which is also made of a cylindrical magnetic material, is disposed coaxially with the armature 28 and on the opposite side of the armature 28 (upward in FIG. 1). An adjusting rod 32 is inserted into the stator 29 to adjust the force of the return spring 31, and such adjusting rod is fixedly crimped by compressing a crimping portion 33. The stator 29 has a flange 34 formed in an angularly projecting shape in the intermediate position thereof. By having the flange 34 crimped to the end part of the casing 26, the stator 29 is fixed to the casing 26 by crimping the end portion of the flange 34.

The electromagnetic coil 30 is wound around a bobbin 35, and is disposed between the casing 26 and the stator 29. O rings 36 and 37 are disposed at both ends of the electromagnetic coil 30 to prohibit the fuel from flowing to the electromagnetic coil 30. The electromagnetic coil 30 is connected to a terminal 38 which is supported in a connector 40 made of mold resin 39.

As shown in FIG. 3, the terminal 38 is connected to an electronic control circuit 41 including a microcomputer. The electronic control circuit 41 controls to supply electricity wit the electromagnetic coil 30 of each fuel injection valve 1. When the electromagnetic coil 30 is supplied with electricity in accordance with the engine condition by the electronic control circuit 41, the electromagnetic coil 30 generates magnetic force and pulls up the armature 28 (upward in FIG. 2) resisting the force of the return spring 31. The mold resin 39 forming the connector 40 includes an annular flange 42. The flange 42 is held between a housing 43 which houses the fuel injection valve 1 and a cap 44. The housing 43 and the cap 44 are fixed by a screw 45 so as to insert the flange 42 therebetween, thereby fixing the fuel injection valve 1 in the housing 43. A cover 46 for filtering fuel is disposed between the casing 26 and the valve casing 7. An annular gap 47 is formed between the housing 43 and the cover 46. The housing 43 includes fuel inlet ports (not shown) to introduce fuel into the annular gap 47 and fuel outlet ports (not shown) to lead the fuel out of the annular gap. The fuel introduced into the gap 47 through the inflow ports flows through the gap 47 to cool the inside and then is led out through the outlet ports. O rings 488 and 49 are disposed between the valve casing 7 and the housing 43 and between the casing 26 surrounding the outer peripheral surface of the electromagnetic coil 30 and the housing 43 to prevent the fuel supplied into the clearance 47 from leaking out of the housing 43.

A fuel supply passage 50 which introduces the fuel supplied into the annular gap 47 to the fuel injection port 10 is now explained.

The fuel supplied into the gap 47 is introduced into the cover 46 through port portions of the cover 46 and mesh filters 52 attached to the inside of the port portions 51. The fuel introduced into the cover 46 is further introduced into the fuel injection valve 1 through feed holes 53 of the valve casing 7 and purge holes 54 of the casing 26, A plurality of feed holes 53 are radially formed around the valve casing 7 so as to introduce fuel into the guide bore 11 between the brim portion 21 in the second fuel adjusting passages 24 and the sliding contact portion 16 on the side of the electromagnetic actuator 9. The purge holes 54 introduces fuel into the gap between the armature 28 and the casing 26 and further into the guide bore 11 through the gap between the stopper 25 and the valve element 8.

Next, the operation of the fuel injection valve 1 as described above is explained.

When the engine is started, the electric pump 4 is actuated and the fuel in the fuel tank 2 is pumped up. The pressure of the fuel within the fuel pipes 3 from the electric pump 4 to the pressure regulating valve 6 is maintained to a constant pressure difference in proportion to the intake pressure by the operation of the pressure regulating valve 6. That is, the pressure of the fuel in the fuel supply passage 50 on the upstream side (with respect to the fuel flow direction) of the second fuel adjusting passages 24 is also regulated by the pressure regulating valve 6.

When the electromagnetic coil 30 of the electromagnetic actuator 9 is electrically actuated by the operation of the electronic control circuit 41, the armature 28 is pulled up to the stator 29 resisting the force of the return spring 31, and the valve element 8 shifts until the flange 27 contacts the stopper 25. Then, the contact portion 19 is part from the valve seat 12 form a gap therebetween as the first fuel adjusting passage 20. Then, the fuel, the pressure of which having been regulated in the upstream from the second fuel adjusting passages 24, is supplied to the second and third fuel adjusting passages 24 and 17*a*, and at the same time, s throttled in the second fuel adjusting passages 24, the third fuel adjusting passages 17*a* and the first fuel adjusting passage 20 respectively, and injected into the intake pipe through the gap between the injection port 10 and the pin 14.

Figure 6:
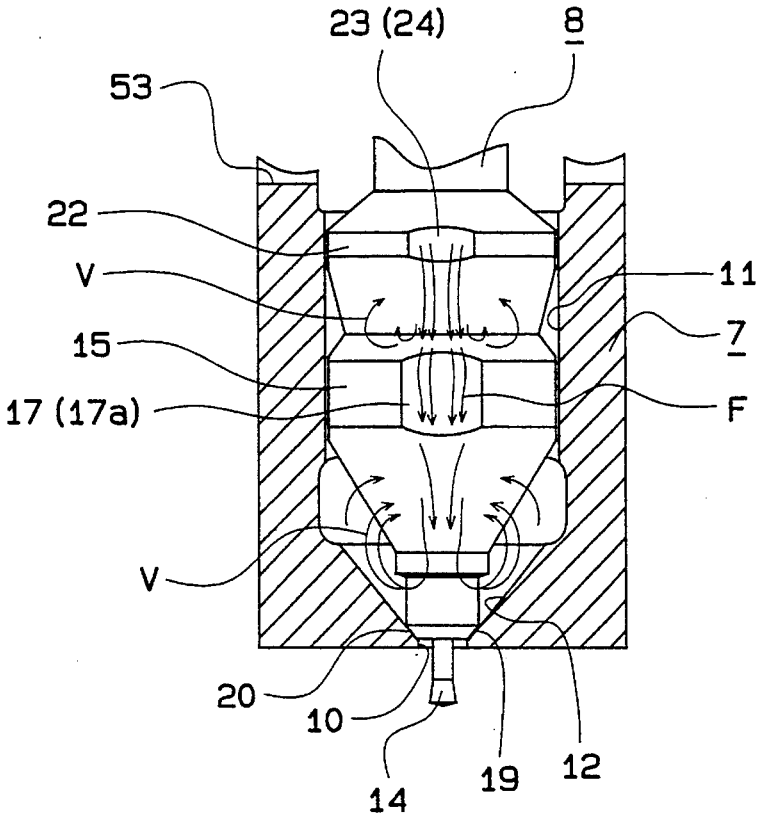
FIG. 6 is a cross-sectional view showing the fuel injection valve for explaining fuel flow in the first embodiment.

FIG. 6 shows the condition of fuel flow F (shown with an arrow) in this embodiment. As shown in FIG. 6, the fuel introduced into the guide bore 11 through the feed holes 53 is throttled in the second fuel adjusting passages 24, and then is further throttled in the third fuel adjusting passages 17*a* positioned on the downstream side of the second fuel adjusting passages 24. By passing through the two fuel adjusting passages (throttles) 24 and 17*a* which are formed continuously, the fuel pressure losses in correspondence to the pressure loss percentage of the respective fuel adjusting passages 24 and 17*a* is caused in fuel. Although eddies V occur between the second fuel adjusting passages 24 and the third fuel adjusting passages 17*a* and between the third fuel adjusting passages 17*a* and the first fuel adjusting passage 20, the eddies V are prevented from flowing back to the upstream side of the second and third fuel adjusting passages 24, 17*a*. Therefore, bad influence of the whirling flow or back flow is restrained and the fuel flow F is regularized.

Then, when the valve element 8 is pulled up by the electromagnetic actuator 9 in the valve open direction (upward in FIG. 6), the fuel supplied from the third fuel adjusting passages 17*a* passes through the first fuel adjusting passage 20 and is injected with the shape and angle of fuel atomization in an generally regularized condition.

Figure 7:
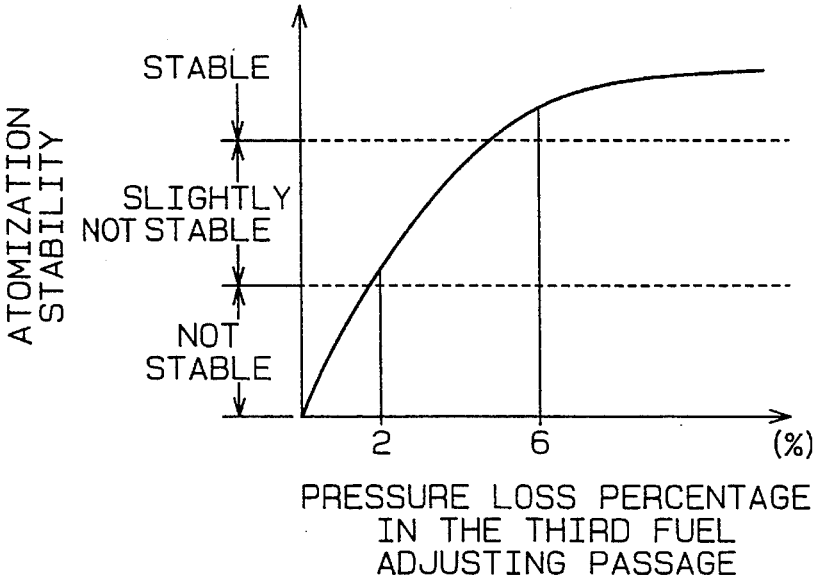
FIG. 7 is a diagram showing the relationship between the pressure loss percentage in the third fuel adjusting passage and the atomization stability.
Figure 8:
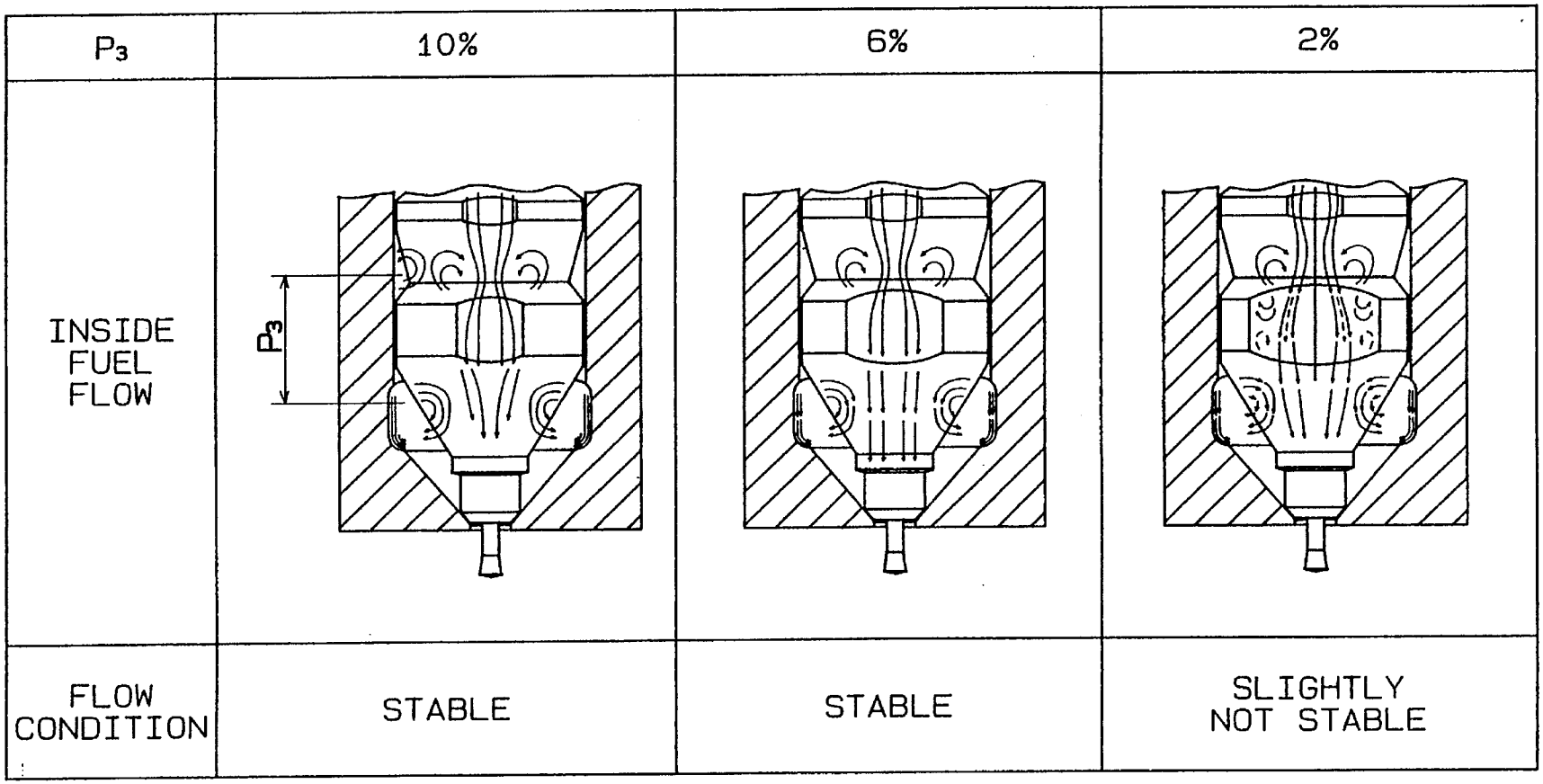
FIG. 8 is a cross-sectional view showing the relationship between the pressure loss percentage in the third fuel adjusting passage and the inside fuel flow in the valve casing.

On the other hand FIGS. 7 and 8 show the results of experiments performed by the inventors in relation to the pressure loss percentage P3 of the third fuel adjusting passages 17*a*.

FIG. 7 shows the relation between the pressure loss percentage P3 of the third fuel adjusting passage 17*a*, P3, and the atomization stability. The atomization stability in FIG. 7 is determined according to the range of variation in the atomization angle and the frequency of the occurrence of the variation, and the smaller these parameter values are, the more stable the atomization is judged to be. As shown in FIG. 7, it is understood that, when the pressure loss percentage P3 of the third fuel adjusting passages la is approx, under 2% the atomization is in the range of "not stable", when the pressure loss percentage P3 is in the range of approx. from 2% to 6%, the atomization is in the range of "slightly stable", and when the pressure loss percentage P3 is over 6%, the atomization is in the range of "stable".

Figure 10:
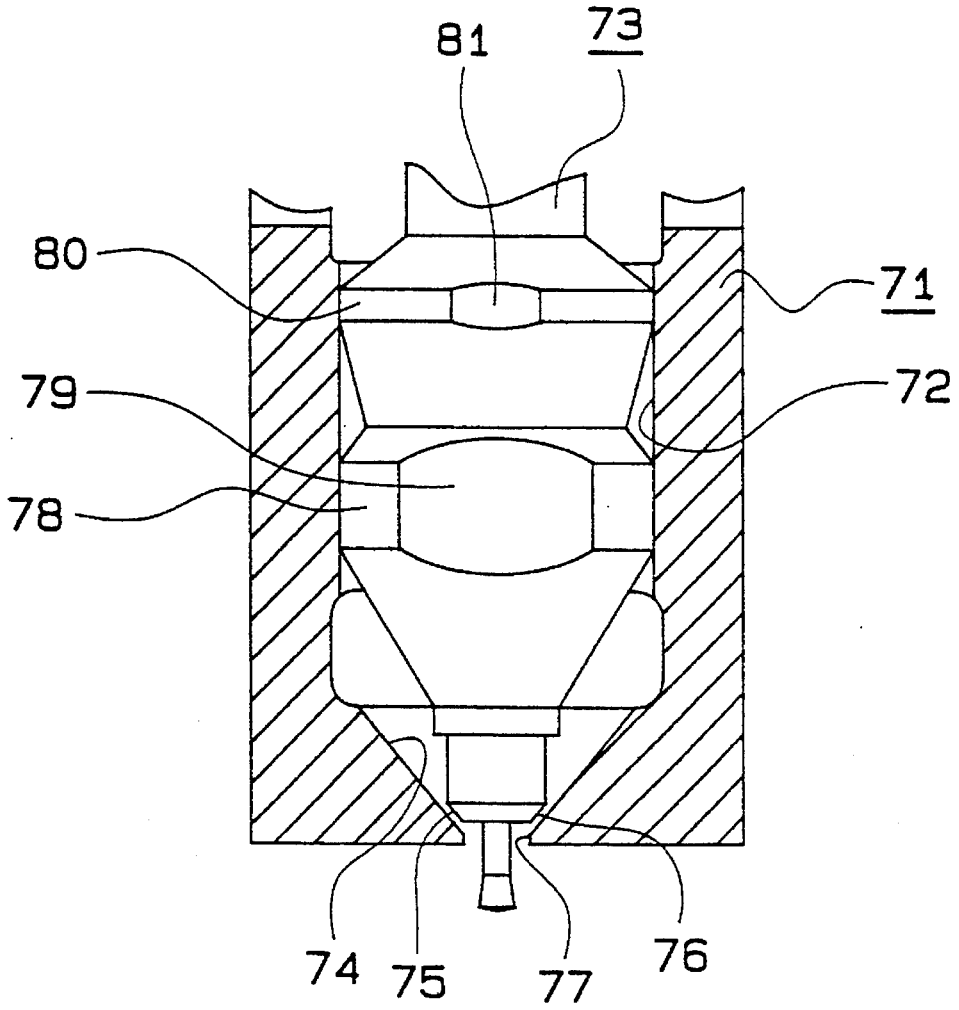
FIG. 10 PRIOR ART
FIG. 10 is a cross-sectional view showing the main portion of conventional type of the fuel injection valve.
Figure 11:
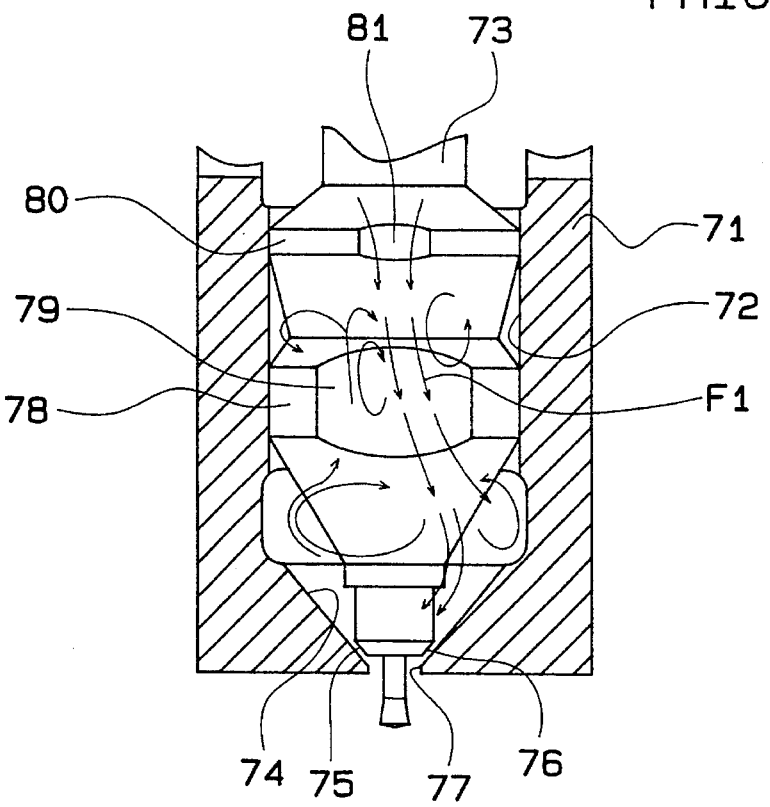
FIG. 11 PRIOR ART
FIG. 11 is a cross-sectional view showing the conventional type of fuel injection valve for explaining the inside fuel flow.
Figure 12:
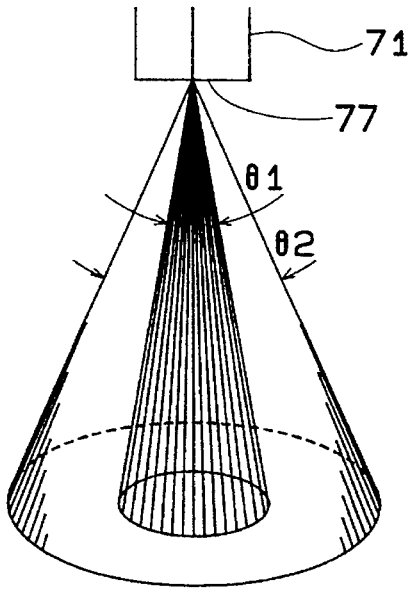
FIG. 12 PRIOR ART
FIG. 12 is a perspective view showing the atomization condition of the conventional type of fuel injection valve.

FIG. 8 shows the relationship between the pressure loss percentage P3 and the fuel flow in the valve casing 7. As shown in FIG. 8, when P3 is 2%, which corresponds to the "slightly not stable" range, small whirl is caused to the fuel flow in the third fuel adjusting passages 17*a*, and when P3 is 6% and 10%, which corresponds to the "stable" range, any whirl is not caused to the fuel flow in the third fuel adjusting passages 17*a*, and stable condition is maintained. It is confirmed from these experimental results that the pressure loss percentage P3 of the third fuel adjusting regulating passages 17*a* should preferably be determined over 6%. Furthermore, if the conventional type of fuel injection valve (shown in FIG. 10) is applied to FIGS. 7 and 8, it is understood that, as the third fuel adjusting passages 17*a* are not provided therein, P3 is 0%, which corresponds to the "not stable" range.

As described above in detail, the fuel injection valve 1 in this embodiment has the gap between the valve seat 12 of the valve casing 7 and the contact portion 19 of the valve element 8 as the first fuel adjusting passage 20, and the second fuel adjusting passages 24 and the third fuel adjusting passages la are continuously formed as throttles on the upstream side of the first fuel adjusting passage 20. The pressure loss percentages P2 and P3 shared by the second and third fuel adjusting passages 24 and 17*a* are set to 6% or more, respectively (P2≧P3≧6%). According to the above configuration, pressure loss is caused to the second and third fuel adjusting passage 24 and 17*a* on the upstream side according to the respective pressure loss percentages, and the development of eddies which occur on the upstream side of the first fuel adjusting passage 20 fuel to the fuel flow to the extent the second fuel adjusting passages 24 is prevented. As a result, the fuel flow is regularized, the atomization into the intake pipe through the injection port 10 and the pin 14 is stabilized, and a good atomization is obtained.

Furthermore, the conventional type of fuel injection valve has a problem that the fuel flow passage through the second fuel adjusting passages 24 is whirled due to a small error in the shape of the fuel adjusting surfaces 23 formed as flat portions of the second fuel adjusting passages 24, and whereby the angle of atomized fuel injected into the intake manifold through the injection port 10 and the pin 14 is wider than the designed angle. According to the embodiment, however, it is possible to loosen the accuracy in the shape of the fuel adjusting surfaces 23 of the second fuel adjusting passages 24. That is, even if torsion to the axial direction of the flat portion of the second and third fuel adjusting passages 24 and 17*a* or a dimensional error (e.g., symmetry with respect to the flat portion) is caused, the adverse influence of such error is minimized.

(SECOND EMBODIMENT)

A second embodiment with some modification of the above first embodiment of fuel injection valve 1 is described.

Figure 9:
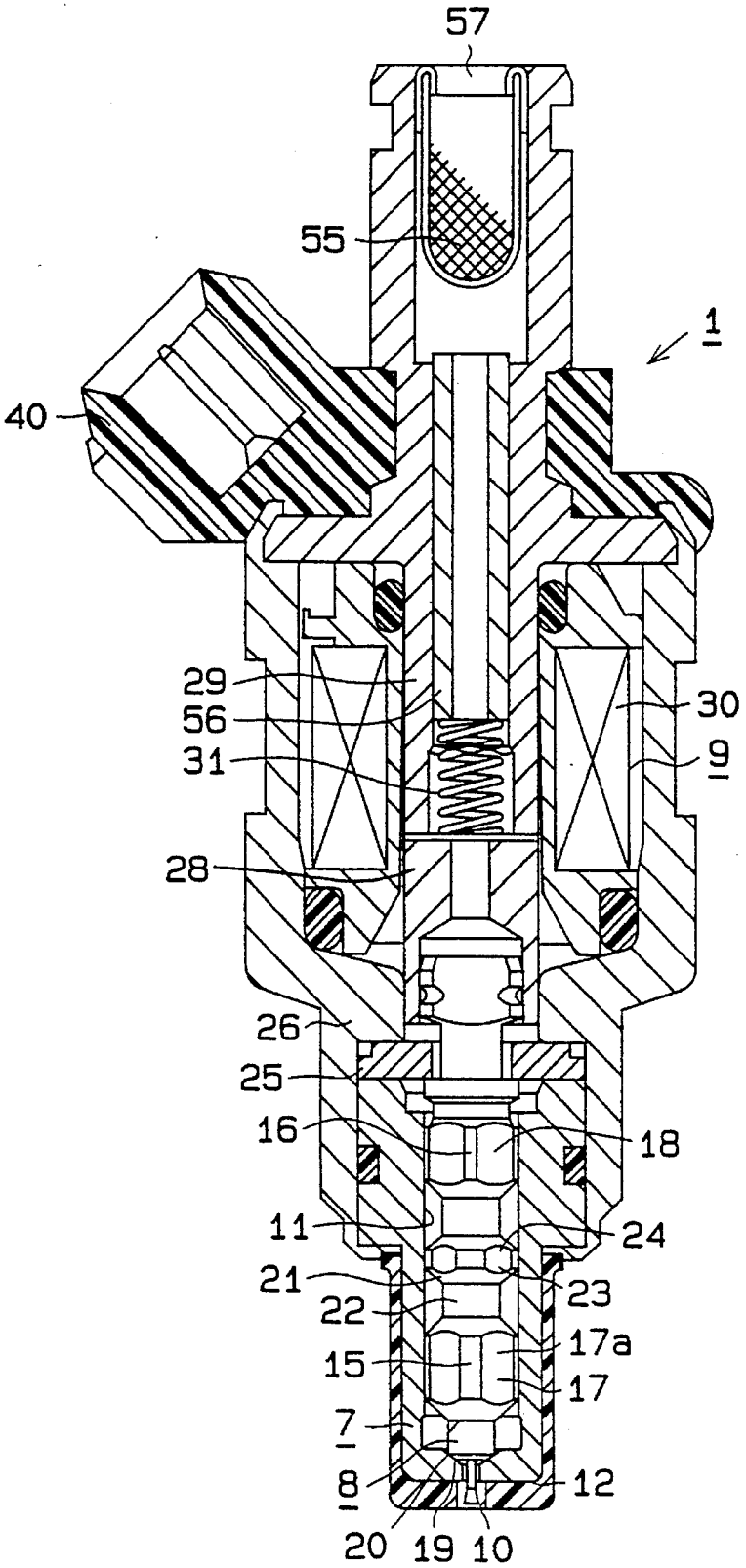
FIG. 9 is a cross-sectional view showing the fuel injection valve in the second embodiment.

As shown in FIG. 9, in the second embodiment, the feed holes 53 in the valve casing 7 and the purge holes 54 in the casing 26 are not provided contrary to the first embodiment. Namely, a tubular regulating rod 56 is disposed in the stator 29 instead. Furthermore, an inlet port 57 is formed on the upstream side of the adjusting rod 56, and a filter 55 is disposed in the inlet port 57.

According to the above configuration of the fuel injection valve 1, the fuel introduced into the inlet port 57 is introduced into the guide bore 11 through the filter 55, the adjusting rod 56, the return spring 31 and the armature 28 and further the gap between the stopper 25 and the valve element 8. The injection quantity of the fuel is adjusted in the guide bore 11 by the predetermined pressure loss by means of the throttle actions of the second fuel adjusting passages 24 and the third fuel adjusting passages 17*a* in the same way as adjusted in the above first embodiment. Furthermore, the injection quantity is further regulated in the first fuel adjusting passage 20 in the valve open position, and then is injected from the injection port 10.

In this second embodiment, a good fuel injection condition is also obtained by the second fuel adjusting passages 24 and the third fuel adjusting passages 17*a* on the upstream side of the first fuel adjusting passage 20.

The present invention is not limited to the above embodiments, but may be modified in many other forms without departing from the spirit or the scope of the present invention, for example, the throttle of the upstream side fuel adjusting passages may be continuously formed over three stages.

What is claimed is:

1. A fuel injection valve for injecting fuel from an injection port comprising:

fuel passage means for defining a fuel passage for connection to said injection port;

a valve seat formed in said fuel passage means;

a valve element disposed in said fuel passage means and being electromagnetically operated to be in a valve open position or in a valve closed position with said valve seat;

said valve element including:

a first sliding contact portion extending radially so as to slide in said fuel passage means and having a first notch portion partially formed thereon, a second sliding contact portion extending radially so as to slide in said fuel passage means and having a second notch portion partially formed thereon, and a brim portion extending radially at an upstream side of said first sliding contact portion, between said first and second sliding contact portions;

first fuel adjusting means forming a first fuel adjusting passage between said valve seat and said valve element for adjusting a quantity of fuel to be injected from said injection port by causing a predetermined pressure loss when said valve element is in said valve open position;

second fuel adjusting means forming a second fuel adjusting passage between said brim portion and said fuel passage means at an upstream side of said first fuel adjusting means and cooperating with said first fuel adjusting means to adjust a quantity of fuel to be injected from said injection port by causing a predetermined pressure loss when said valve element is in said valve open position; and third fuel adjusting means formed on said first notch portion so as to form a third fuel adjusting passage and cooperating with said first and second fuel adjusting means to adjust a quantity of fuel to be injected from said injection port by causing a predetermined pressure loss when said valve element is in said valve open position;

wherein the cross-sectional area of a passage formed between said second notch portion and said fuel passage means is greater than that of said third fuel adjusting passage.

2. A fuel injection valve for injecting fuel from an injection port comprising:

fuel passage means for defining a fuel passage for connection to said injection port and having a valve seat formed in said fuel passage means;

a valve element disposed in said fuel passage means and being electromagnetically operated to be in a valve open position or in a valve close position with said valve seat;

first fuel adjusting means forming a first fuel adjusting passage between said valve seat and said valve element for adjusting a quantity of fuel to be injected from said injection port by causing a predetermined pressure loss when said valve element is in said valve open position;

wherein said valve element includes:

a first sliding contact portion extending radially at an upstream side of said first fuel adjusting means so as to slide in said fuel passage means and having a notch portion partially formed on said first sliding portion so as to form a first fuel passage in said fuel passage, a second sliding contact portion formed at an upstream side of said first sliding contact portion, extending radially so as to slide in said fuel passage means and having a notch portion partially formed on said second sliding contact portion so as to form a second fuel passage in said fuel passage, and a brim portion formed between said first sliding contact portion and second sliding contact portion and extending radially so as to form a third fuel passage in said fuel passage, each cross-sectional area of said first fuel adjusting passage, said first fuel passage, said second fuel passage and said third fuel passage are satisfied with the following relationship:

first fuel adjusting passage<third fuel passage<first fuel passage<second fuel passage.

3. A fuel injection valve according to claim 2, wherein said brim portion includes a body portion which slides in said fuel passage means and a notch portion formed on said body portion so as to form said third fuel passage.

4. A fuel injection valve according to claim 3, wherein said notch portion on said first sliding contact portion is in alignment with said notch portion on said brim portion with respect to fuel flow.

5. A fuel injection valve according to claim 2, wherein pressure loss percentage in said first fuel passage is equal to or over 6%.

6. A fuel injection valve for injecting fuel from an injection port comprising:

fuel passage means for defining a fuel passage for connection to said injection port;

a valve seat formed in said fuel passage means;

a valve element disposed in said fuel passage means and being electromagnetically operated to be in a valve open position or in a valve close position with said valve seat, said valve element including:

a first sliding contact portion extending radially so as to slide in said fuel passage means, and a brim portion extending radially at an upstream side of said first sliding contact portion, said brim portion including a body portion extending radially so as to slide in said fuel passage means, first fuel adjusting means forming a first fuel adjusting passage between said valve seat and said valve element for adjusting a quantity of fuel to be injected from said injection port by causing a predetermined pressure loss when said valve element is in said valve open position;

second fuel adjusting means formed on said brim portion at an upstream side of said first fuel adjusting means and cooperating with said first fuel adjusting means for adjusting a quantity of fuel to be injected from said injection port by causing a predetermined pressure loss when said valve element is in said open position, said second fuel adjusting means including a notch portion partially formed on said body portion so as to form a second fuel adjusting passage; and third fuel adjusting means formed on said first contact sliding portion at an upstream side of said first adjusting means and cooperating with said first and second fuel adjusting means for adjusting a quantity of fuel to be injected from said injection port by causing a predetermined pressure loss when said valve element is in said open position, said third fuel adjusting means including a notch portion partially formed on said first contact sliding portion so as to form a third fuel adjusting passage, said notch portion on said first contact portion being in alignment with said notch portion on said brim portion with respect to fuel flow;

said valve element further comprising a second sliding contact portion extending radially at an upstream side of said brim portion so as to slide in said fuel passage means, and said second sliding contact portion including a notch portion partially formed on said second sliding contact portion so as to form an upstream side fuel passage having a cross-sectional area of greater than that of said third fuel adjusting passage.

7. A fuel injection valve according to claim 6, wherein said notch portion on said second sliding contact portion is in alignment with said notch portion on said body portion with respect to fuel flow.

8. A fuel injection valve for injecting fuel from an injection port comprising:

fuel passage means for defining a fuel passage for connection to said injection port;

a valve seat formed in said fuel passage means;

a valve element disposed in said fuel passage means and being electromagnetically operated to be in a valve open position or in a valve close position with said valve seat, first fuel adjusting means forming a first fuel adjusting passage between said valve seat and said valve element for adjusting a quantity of fuel to be injected from said injection port by causing a predetermined pressure loss when said valve element is in said valve open position;

second fuel adjusting means formed at an upstream side of said first fuel adjusting means and cooperating with said first fuel adjusting means for adjusting a quantity of fuel to be injected from said injection port by causing a predetermined pressure loss percentage P2 when said valve element is in said open position; and third fuel adjusting means formed between said first fuel adjusting means and said second fuel adjusting means and cooperating with said first and second fuel adjusting means for adjusting a quantity of fuel to be injected from said injection port by causing a predetermined pressure loss percentage P3 when said valve element is in said open position;

said pressure loss percentage P2 in said second fuel adjusting means being at least equal to said pressure loss percentage P3 in said third fuel adjusting means, said percentage P3 being over 2%.

9. A fuel injection valve for injecting fuel from an injection port comprising:

fuel passage means for defining a fuel passage for connection to said injection port; a valve seat formed in said passage means;

a valve element disposed in said fuel passage means and being electromagnetically operated to be in a valve open position or in a valve close position with said valve seat, first fuel adjusting means forming a first fuel adjusting passage between said valve seat and said valve element for adjusting a quantity of fuel to be injected from said injection port by causing predetermined pressure loss when said valve element is in said valve open position;

second fuel adjusting means formed at an upstream side of said first fuel adjusting means and cooperating with said first fuel adjusting means for adjusting a quantity of fuel to be injected from said injection port by causing a predetermined pressure loss when said valve element is in said open position; and third fuel adjusting means formed between said first fuel adjusting means and said second fuel adjusting means and cooperating with said first and second fuel adjusting means for adjusting quantity of fuel to be injected from said injection port by causing a predetermined pressure loss when said valve element is in said open position;

said pressure loss in said third fuel adjusting means being over 6% of the total pressure loss.

10. A fuel injection valve for injecting fuel from an injection port comprising:

fuel passage means for defining a fuel passage for connection to said injection port therein;

a valve seat formed in said fuel passage means;

a valve element disposed in said fuel passage means and being electromagnetically operated to be in a valve open position or in a valve close position with said valve seat, first fuel adjusting means forming a first fuel adjusting passage between said valve seat and said valve element for adjusting a quantity of fuel to be injected from said injection port by causing a predetermined pressure loss percentage P1 when said valve element is in said valve open position;

second fuel adjusting means formed at an upstream side of said first fuel adjusting means and cooperating with said first fuel adjusting means for adjusting a quantity of fuel to be injected from said injection port by causing a predetermined pressure loss percentage P2 when said valve element is in said open position; and third fuel adjusting means formed between said first fuel adjusting means and said second fuel adjusting means and cooperating with said first and second fuel adjusting means for adjusting a quantity of fuel to be injected from said injection port by causing a predetermined pressure loss percentage P3 when said valve element is in said open position;

said pressure loss percentage P2 in said second fuel adjusting means being at least equal to of said pressure loss percentage P3 in said third fuel adjusting means, a total of said percentages P2+P3 being equal to or less than said pressure loss percentage P1 in said first fuel adjusting means.

* * * * *